US009908254B2

(12) United States Patent
Buettner et al.

(10) Patent No.: US 9,908,254 B2
(45) Date of Patent: Mar. 6, 2018

(54) TOOL SYSTEM WITH INTERCHANGEABLE TOOL INSERTS FOR PUNCHING MACHINES

(71) Applicant: TRUMPF Werkzeugmaschinen GmbH + Co. KG, Ditzingen (DE)

(72) Inventors: Stefan Buettner, Markgroeningen (DE); Wolfgang Laib, Besigheim (DE)

(73) Assignee: TRUMPF Werkzeugmaschinen GmbH + Co. KG, Ditzingen (DE)

( * ) Notice: Subject to any disclaimer, the term of this patent is extended or adjusted under 35 U.S.C. 154(b) by 419 days.

(21) Appl. No.: 14/048,697

(22) Filed: Oct. 8, 2013

(65) Prior Publication Data

US 2014/0033887 A1 Feb. 6, 2014

Related U.S. Application Data

(62) Division of application No. 12/635,279, filed on Dec. 10, 2009, now Pat. No. 8,567,228.

(30) Foreign Application Priority Data

Dec. 10, 2008 (EP) ..... 08021443

(51) Int. Cl.
*B26F 1/44* (2006.01)
*B21D 28/12* (2006.01)
(Continued)

(52) U.S. Cl.
CPC ..... *B26F 1/44* (2013.01); *B21D 28/12* (2013.01); *B21D 28/34* (2013.01); *B21D 28/343* (2013.01);
(Continued)

(58) Field of Classification Search
CPC ..... B21D 28/12; B21D 28/24; B21D 28/34; B21D 28/343; B21D 28/346; B21D 37/02;
(Continued)

(56) References Cited

U.S. PATENT DOCUMENTS 2,580,366 A * 12/1951 Smith ..... B21D 28/34 83/686
3,797,352 A 3/1974 Smith
(Continued)

FOREIGN PATENT DOCUMENTS

DE 3631457 3/1988
DE 9405417.7 7/1994
(Continued)

OTHER PUBLICATIONS

Search Report from European Patent Office from corresponding European Application No. 08021443.0, dated Apr. 20, 2009 with English translation.

*Primary Examiner* — Teresa M Ekiert
*Assistant Examiner* — Gregory Swiatocha
(74) *Attorney, Agent, or Firm* — Fish & Richardson P.C.

(57) ABSTRACT

A tool system is provided that has a stamp or punch adapter including eccentrically positioned stamp receptacles. This system permits a simple exchange of tool inserts in the stamp adapter. These tool inserts are also usable in another tool system. The system also permits combining the stamp adapter with a stamp shaft, which can also be used in another tool system. These features permit stamping (and punching) with minimal tooling and retooling efforts.

13 Claims, 5 Drawing Sheets

(51) Int. Cl.

| | |
|---|---|
| ***B21D 28/34*** | (2006.01) |
| ***B26F 1/14*** | (2006.01) |
| ***B21D 37/02*** | (2006.01) |
| ***B21D 37/04*** | (2006.01) |
| ***B21D 37/10*** | (2006.01) |

(52) U.S. Cl.
CPC ..... *B21D 28/346* (2013.01); *B21D 37/02* (2013.01); *B21D 37/04* (2013.01); *B21D 37/10* (2013.01); *B26F 1/14* (2013.01); *Y10T 83/8748* (2015.04); *Y10T 83/9416* (2015.04); *Y10T 83/9423* (2015.04); *Y10T 83/9425* (2015.04); *Y10T 83/97* (2015.04)

(58) Field of Classification Search
CPC . B21D 37/04; B21D 37/10; B26F 1/44; B26F 1/14; Y10T 83/8748; Y10T 83/9416; Y10T 83/9423; Y10T 83/9425; Y10T 83/97; B23Q 3/155; B23Q 2003/15586
USPC ..... 72/481.1, 481.3, 481.8
See application file for complete search history.

(56) References Cited

U.S. PATENT DOCUMENTS

| | | | | |
|---|---|---|---|---|
| 4,171,656 | A | 10/1979 | Gargrave | |
| 4,929,276 | A | 5/1990 | Chun et al. | |
| 5,133,237 | A * | 7/1992 | Daffe | B21D 28/34 83/140 |
| 5,390,575 | A | 2/1995 | Saito | |
| 5,438,897 | A * | 8/1995 | Chun | B21D 45/006 83/139 |
| 5,495,671 | A | 3/1996 | Shun-Yi | |
| 5,715,721 | A | 2/1998 | Anders et al. | |
| 6,716,146 | B2 | 4/2004 | Kato | |
| 6,895,797 | B2 * | 5/2005 | Lowry | B21D 28/12 72/480 |
| 6,959,582 | B2 * | 11/2005 | Peterhansel | B21D 28/10 72/393 |
| 7,156,795 | B2 | 1/2007 | Nolte et al. | |
| 7,194,820 | B2 * | 3/2007 | Schweiger | B21D 28/12 29/465 |
| 7,461,579 | B2 | 12/2008 | Kobayashi | |
| 7,726,554 | B2 | 6/2010 | Thielges et al. | |
| 8,201,435 | B2 * | 6/2012 | Erlenmaier | B21D 28/24 72/442 |
| 2001/0020410 | A1 * | 9/2001 | Janek, Jr. | B21D 28/34 83/669 |
| 2001/0039867 | A1 | 11/2001 | Ostini | |
| 2002/0050203 | A1 * | 5/2002 | Phlipot | B21D 19/005 83/694 |
| 2007/0034069 | A1 * | 2/2007 | Endo | B21D 45/006 83/684 |
| 2007/0261466 | A1 | 11/2007 | Lee et al. | |
| 2008/0092711 | A1 | 4/2008 | Thielges et al. | |
| 2009/0211326 | A1 * | 8/2009 | Laib | B21D 28/12 72/332 |
| 2009/0223273 | A1 | 9/2009 | Erlenmaier | |

FOREIGN PATENT DOCUMENTS

| | | |
|---|---|---|
| GB | 2195937 | 4/1988 |
| JP | 02142626 | 5/1990 |
| WO | 2008046501 | 4/2008 |
| WO | 2009012028 | 1/2009 |

* cited by examiner

TOOL SYSTEM WITH INTERCHANGEABLE TOOL INSERTS FOR PUNCHING MACHINES

CROSS-REFERENCE TO RELATED APPLICATIONS

This application is a divisional of and claims priority under 35 U.S.C. § 120 to U.S. application Ser. No. 12/635,279, filed on Dec. 10, 2009, which claimed priority under 35 U.S.C. § 119(a) to European Application No. 08 021 443.0, filed on Dec. 10, 2008, the entire contents of which are hereby incorporated by reference.

TECHNICAL FIELD

This disclosure relates to a tool system having interchangeable tool inserts for punching machines, in particular, a modular system for punching with minimal tooling efforts.

BACKGROUND

To machine patterns in plate-type elements and sheets, a punching machine may be used. The punching machine includes punching tool inserts, such as punching stamps, that perform operations including, for example, stretching, bending and cutting of the plate-type elements in association with a punching die. As the punching tool inserts, e.g., punching stamps are used, they become dull or blunt, and need to be sharpened by a process called regrinding. The problem is that regrinding shortens the overall length of the punching tool inserts.

To compensate for the length of the reground punching stamps, systems are known that include multi-part punching tools that include a stamp shaft, which is suitable for use with several different punching stamps, a punching stamp centrally arranged in the stamp shaft and that can be reground, and inlay plates. Where applicable, inlay plates having different thicknesses can be inserted into the stamp shaft in a number appropriate to compensate for the variation in length of the punching stamps due to regrinding, which changes the punching stamp length.

When the length of the stamp shaft is worn down due to regrinding such that the length of the punching stamp can no longer be compensated by the insertion of plates, the stamp insert can be replaced without having to replace the stamp shaft. In addition, stamp inserts having different shapes or sizes can be used with a single stamp shaft.

A large number of tool sets may be required for economically machining sheets on punching machines given that punching is preferably performed using a single punching stroke and a separate stamp may be required for each different contour. For machining sheets having different thicknesses, dies in different sizes may be required for each stamp depending on the thickness of the sheet metal. Accordingly, tool sets may be pre-mounted to the punching machine, i.e., the tool sets are inserted in a tool magazine of the punching machine, which can increase size requirements for tool magazines.

For this reason, punching tools are used in which the stamp or machining inserts are not accommodated in the central axis of the tool. In addition, the correlation of a die of a certain size and a punching insert in the tool upper portion can be changed by twisting a tool upper portion relative to a tool lower portion. Therefore, the machine can be operated for different sheet thicknesses without remounting the tool and, as a result, punching is possible with reduced tooling effort.

A problem can arise when punching with such systems, because off-center axis stamps having different contours or sizes may each be used to punch different sheet thicknesses, such that the stamps wear down and require the replacement of expensive tool upper portions having off-center axis stamps.

SUMMARY

The present disclosure describes a tool system that enables an economical use of stamping inserts for punching with minimal retooling time and effort. A stamp adapter and tool upper portion are disclosed that allow pre-existing machine inserts to be easily used and replaced in a punching tool system.

In general, in one aspect, a stamp adapter for a tool system includes a first central axis, a mounting device for accommodating the stamp adapter in a stamp shaft, and a stamp receptacle having a first opening. The first opening includes a second central axis extending parallel to and separate from the first central axis, a first through-hole through which the second central axis extends, and a first counterbore, in which the first counterbore is not rotationally symmetrical with respect to the second central axis or the first counterbore includes at least one recess that is not rotationally symmetrical with respect to the second central axis.

Embodiments of the stamp adapter can include one or more of the following features and/or features of other aspects. For example, in some embodiments, the stamp adapter can further include a second stamp receptacle having a second opening, a third central axis extending parallel to and separate from the first central axis, a second through-hole, through which the third central axis extends, and a second counterbore, in which the second counterbore is not rotationally symmetrical with respect to the third central axis or the second counterbore includes at least one recess that is not rotationally symmetrical with respect to the third central axis. The stamp adapter can further include a third stamp receptacle having a third opening and a third through-hole with a fourth central axis, where a distance between the first central axis and the third central axis is identical to a distance between the first central axis and the fourth central axis.

In some embodiments, the first counterbore includes a first sector having a circular inner circumferential face with respect to the second central axis, and a second sector, in which an inner face of the second sector is parallel to a tangent of the through-hole, and a distance between the inner face of the second sector and the second central axis is bigger than a radius of the first through-hole and smaller than a radius of the first sector of the first counterbore. In certain implementations, the counterbore is cylindrical.

In some embodiments, the stamp adapter includes a second stamp receptacle having a second opening and a third central axis, in which a distance between the first central axis and the second central axis is identical to a distance between the first central axis and the third central axis.

In certain implementations, the stamp adapter includes a central thread around the first central axis to connect with the stamp shaft using a first screw. In some embodiments, the stamp adapter includes a second through-hole to receive a second screw for screwing on a tool insert.

In another aspect, a stamp adapter includes a first central axis, a mounting device for accommodating the stamp adapter in a stamp shaft, a first stamp receptacle having a first opening and a first through-hole in the first opening, through which a second central axis extends in parallel with and separate from the first central axis, and a second stamp receptacle having a second opening and a third central axis extending parallel to and separate from the first central axis.

In some embodiments, the second stamp receptacle includes a second through-hole around the third central axis, in which the second stamp receptacle has a diameter that is different from a diameter of the first through-hole, and in which the third central axis is separate from the second central axis.

In another aspect, a tool upper portion includes a stamp shaft, a stamp adapter, and at least one interchangeable tool insert. The stamp adapter can include a first central axis, a mounting device for accommodating the stamp adapter in a stamp shaft, and a stamp receptacle having a first opening. The first opening includes a second central axis extending parallel to and separate from the first central axis, a first through-hole through which the second central axis extends, and a first counterbore, in which the first counterbore is not rotationally symmetrical with respect to the second central axis or the first counterbore includes at least one recess that is not rotationally symmetrical with respect to the second central axis.

Implementations of the tool upper portion can include one of more of the following features and/or features of other aspects. For example, in some embodiments, the tool upper portion can include a fastener and the stamp shaft can be configured to be separated from the stamp adapter by loosening a connection between the stamp shaft and the stamp adapter.

In certain implementations, the stamp shaft and the stamp adapter include a rotation lock.

In another aspect, a tool system for a punching machine can include a tool upper portion and a tool lower portion having a die adapter having at least two die receptacles, in which a die configured to receive the tool insert is provided in each of the receptacles. The tool upper portion can include a stamp shaft, a stamp adapter, and at least one interchangeable tool insert. The stamp adapter of the tool upper portion can include a first central axis, a mounting device for accommodating the stamp adapter in a stamp shaft, and a stamp receptacle having a first opening. The first opening includes a second central axis extending parallel to and separate from the first central axis, a first through-hole through which the second central axis extends, and a first counterbore, in which the first counterbore is not rotationally symmetrical with respect to the second central axis or the first counterbore includes at least one recess that is not rotationally symmetrical with respect to the second central axis.

Implementations of the tool system can include one of more of the following features and/or features of other aspects. For example, in some embodiments, the die adapter includes a fourth central axis and each die receptacle includes a fifth central axis, and a distance between the first central axis and the second central axis is identical to a distance between the fourth central axis and the fifth central axis. The die adapter can include die receptacles, in which each die receptacle has a second opening and a respective sixth central axis, and a distance between the first central axis and the third central axis is identical to a distance between the fourth central axis and the sixth central axis.

The details of one or more embodiments are set forth in the accompanying drawings and the description below. Other features, objects, and advantages will be apparent from the description and drawings, and from the claims

DETAILED DESCRIPTION

Figure 1:
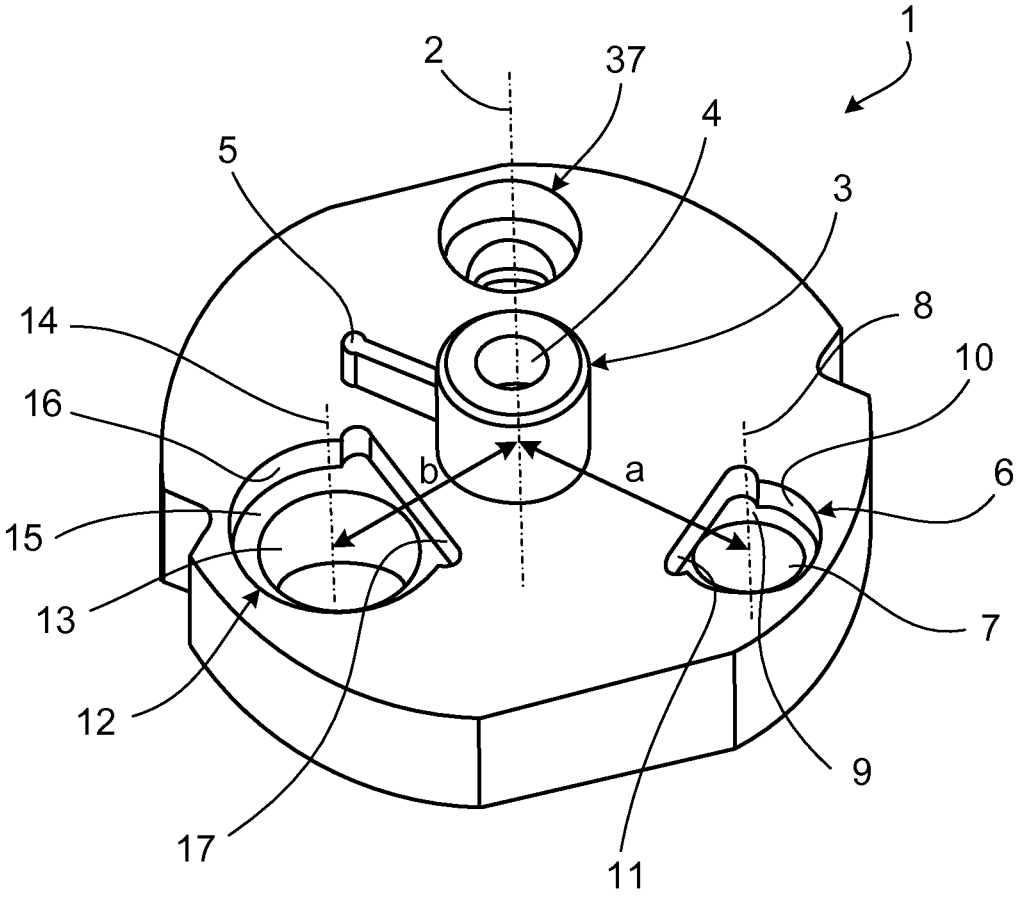
FIG. 1 is a perspective illustration of a stamp adapter.

In FIG. 1, a stamp adapter 1 is illustrated in a perspective illustration. The stamp adapter 1 is formed as a substantially disc-shaped circular body having a first central axis 2. On the upper side, the stamp adapter 1 includes a mounting device 3 in the center for receiving a stamp shaft.

The mounting device 3 includes a circular cylindrical elevation, the axis of which corresponds to the first central axis 2. At the junction of the peripheral face in the axial direction and an abutting face which is radial to the central axis 2, a circumferential chamfer is provided. The mounting device 3 is formed hollow by a bore and it includes a thread 4 at the circumference of the bore. Furthermore, a substantially cuboid-shaped rod-like elevation 5 which is radial to the central axis 2 extends on the upper side of the disc-shaped body.

The disc-shaped body is provided with a stamp receptacle 10 having a first opening for receiving tool inserts 26 of a first tool system. The first stamp receptacle 6 includes a circular cylindrical through-hole 7 having a second central axis 8 at a distance "a" from the first central axis 2. Around the second central axis 8, the disc-shaped body includes a cylindrical counterbore 9 beginning at the upper side of the disc-shaped body. The counterbore 9 includes a sector having a circular inner circumferential face 11 relating to the second central axis 8, and a sector in which the inner face 11 is parallel to a tangent at the through hole 7. The distance between the tangential inner face 11 and the second central axis 8 is bigger than the radius of the through-hole 7 and smaller than the radius of the circular sector of its counterbore 9.

In an alternative embodiment, the disc-shaped body is provided with several first stamp receptacles 6, all of them having the same distance a between the first central axis 2 and the second central axis 8.

Furthermore, the disc-shaped body is provided with a stamp receptacle 12 having a second opening. The stamp receptacle 12 includes a circular cylindrical through-hole 13 having a third central axis 14 at a distance b from the first central axis 2. The diameter of the through-hole 13 and the diameter of the through-hole 7 of the stamp receptacle having the first opening are different. Around the third central axis 14, the disc-shaped body includes a cylindrical counterbore 15 beginning at the upper side of the disc-shaped body. The counterbore 15 includes a sector having a circular inner circumferential face 16 relating to the third central axis 14, and a sector, in which the inner face 17 is parallel to a tangent at the through-hole 13. The distance between the tangential inner face 17 and the third central axis 14 is bigger than the radius of the counterbore 13 and smaller than the radius of the circular section of the counterbore 15.

In alternative embodiments, the disc-shaped body either is provided with no stamp receptacle 12 or with multiple stamp receptacles 12, and if present, all of them have the same distance b between the first central axis 2 and the third central axis 14.

Furthermore, in some embodiments, the first and/or the second stamp receptacle can include a counterbore with another contour, which is not rotationally symmetrical. Alternatively, or in addition, the contour can be conical. Alternatively, or in addition, the stamp receptacles do not include any counterbore. In some embodiments, one or several recesses can be provided at the circumference of the bore or the counterbore, in which the one or more recesses are not rotationally symmetrical to their central axis.

Similar to the stamp receptacles, a through-hole 37 can be provided in the disc-shaped body for fixing tool inserts of a second tool system, having a cylindrical counterbore.

Figure 2:
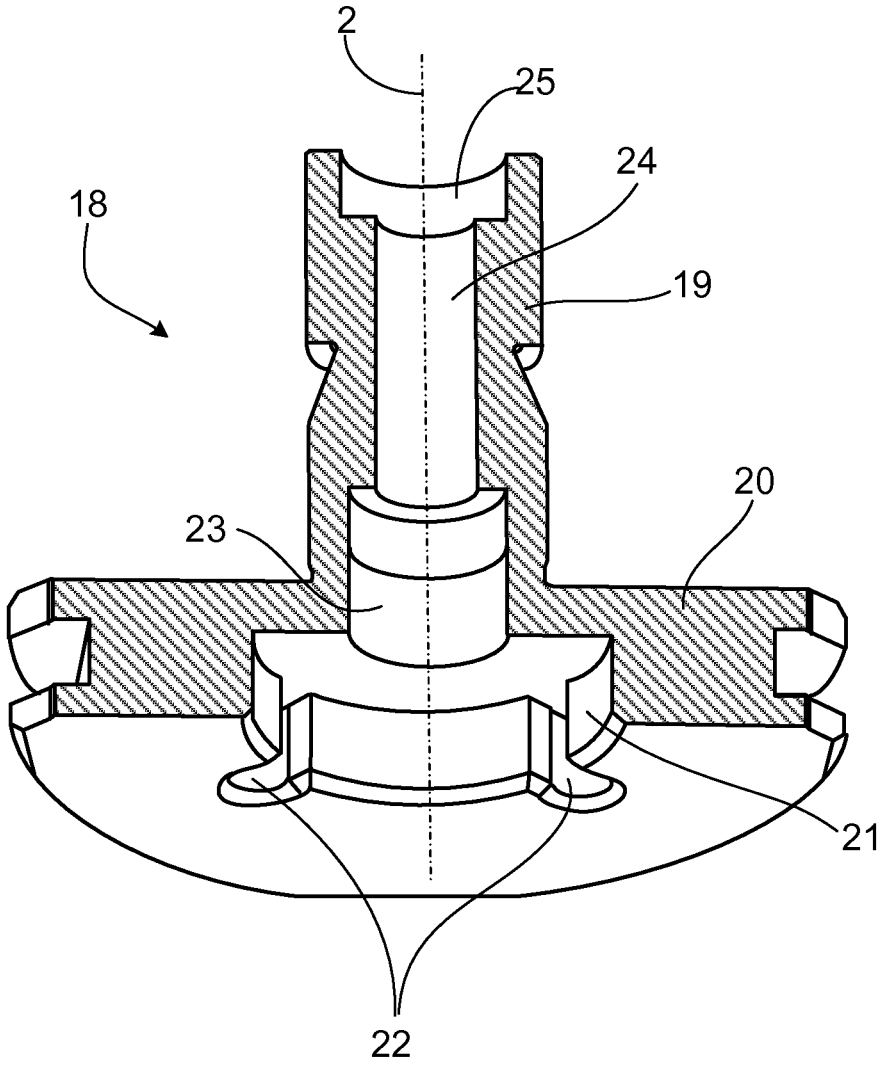
FIG. 2 is a perspective illustration of a stamp shaft.

In FIG. 2, a perspective illustration of a section through a stamp shaft 18 is shown. The stamp shaft 18 includes a central axis which is identical with the central axis 2 of the stamp adapter 1 in an assembled state shown in FIG. 3. In its upper region, the stamp shaft 18 includes a pivot 19 having a shape such that the stamp shaft can be received in an upper tool receptacle of a punching machine. Adjacent to that, the stamp shaft 18 includes a disc-shaped region 20. The disc-shaped region 20 has an outer contour with which a later described tool upper portion can be accommodated in a tool cassette. Departing from its bottom side, the disc-shaped region 20 includes a circular cylindrical counterbore 21 having a certain depth. At the outer circumference of the counterbore 21, several, here three, radial orientated cylindrical recesses 22 can be provided. Furthermore, an additional cylindrical counterbore 23 and a through-hole 24 having an above lying cylindrical counterbore 25 can be provided in the direction of the axis 2 above the counterbore 21.

Due to the arrangement of the counterbore 21 having the recesses 22, the counterbore 23 and the through-hole 24 having the cylindrical counterbore 25, centric receiving and fixing of standard tool inserts having a certain size and forming of the fitting devices of the tools may be possible. Here, the recesses 22 serve a defined orientation of standard tool inserts related to the stamp shaft 18.

Figure 3:
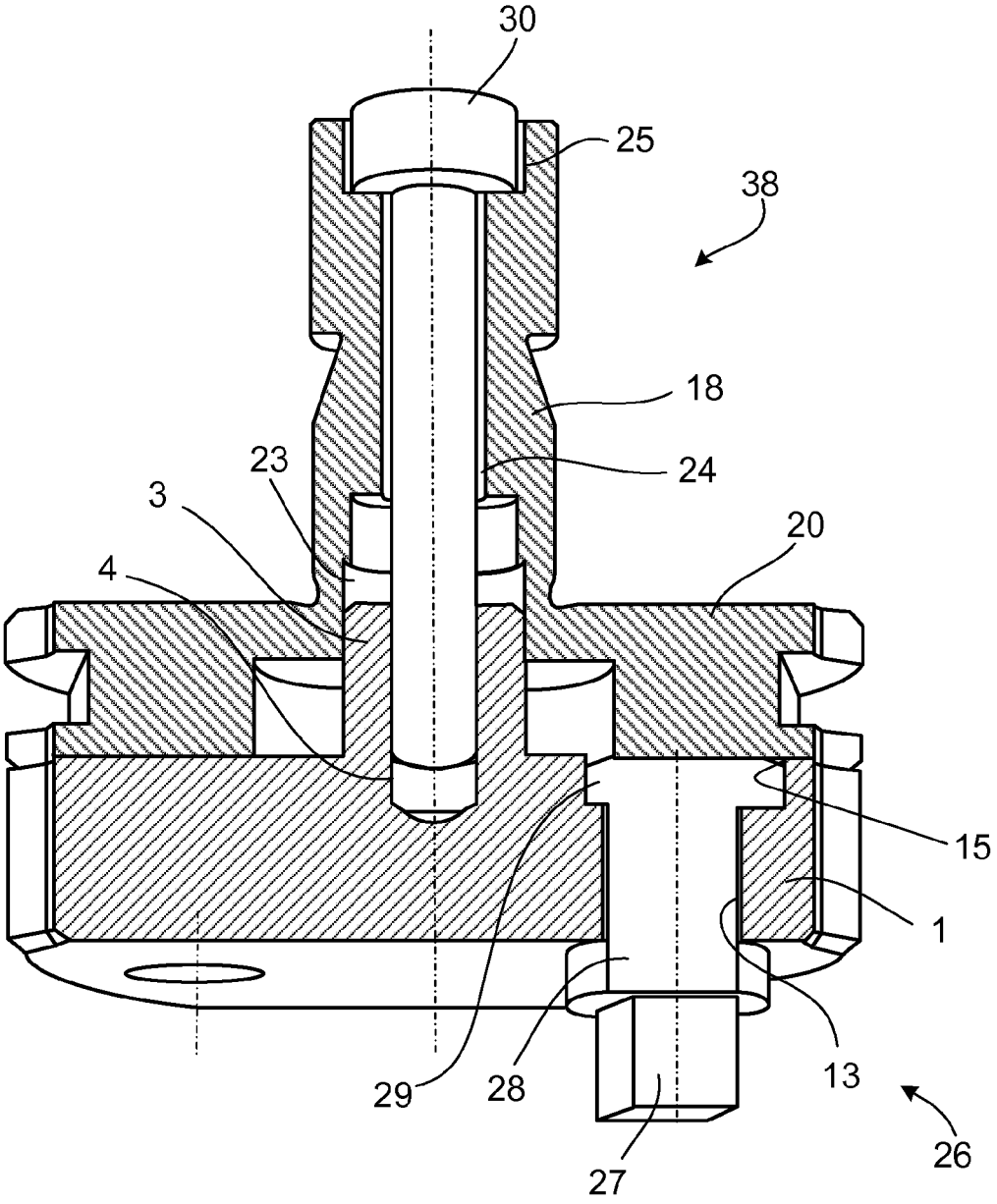
FIG. 3 is a cross-sectional illustration of a tool upper portion having a stamp shaft, a stamp adapter, and a tool insert.

FIG. 3 is a sectional illustration of a tool upper portion 38 having the stamp shaft 18, the stamp adapter 1 and a tool insert 26 in the position of assembly.

The tool insert 26 includes a section 27 at the lower end, having a quadratic contour. The contour of the section 27 depends on the contour of a cutout in a plate-shaped body to be produced. Subsequently, a further cylindrical section 28 having a circular shape extends from section 27. The diameter of the cylindrical section 28 is adapted with the through-hole 13 such that an axial friction bearing exists. At the upper end of the tool insert 26, an additional cylindrical section 29 having a contour that is complementary to the contour of the counterbore 15 is included. Due to the tangential faces 17 (FIG. 1) in the contour of the counterbore 15 and the contour of the section 29 which is complementary to them, the tool insert 26 is prevented from twisting.

In the case of a counterbore having another contour which is not rotation symmetrical like the counterbore 15 in FIG. 1, the tool insert can be prevented from twisting by a section of the tool insert which is complementary to the contour of the section of this counterbore. The section can be designed so that a sector of the section engages with the contour of the counterbore, such that twisting of the tool insert is prevented.

In embodiments in which no counterbores are provided in the disc-shaped body, the tool insert can prevent twisting by other suitable means.

Furthermore, a tool insert can alternatively be fixed by screwing a second screw through the through-hole 37 which is provided with a counterbore.

The stamp adapter 1 inserts its mounting device 3 in the counterbore 23 of the stamp shaft 18 so that the mounting device 3 and, as a result, the stamp adapter 1 are centered in a radial direction with respect to the counterbore 23 and the stamp shaft 18. For fixing the stamp adapter 1 in the stamp shaft 18, a screw 30 is provided. The screw 30 is supported in the counter-bore 25, projects through the through-hole 24, and is screwed with the thread 4 of the stamp adapter. Therefore, the upper side of the disc-shaped region of the stamp adapter 1 abuts on the lower side of the disc-shaped region 20 of the stamp shaft 18.

The stamp adapter 1 is orientated to the stamp shaft 18 such that the substantial cuboid-shaped rod-like elevation 5 (FIG. 1) lies in one of the three recesses 22 (FIG. 2), such that the orientation of the stamp adapter 1 is defined relative to the stamp shaft 18, and the elevation 5 and one of the three recesses 22 serve as rotation lock. The rotation lock between the stamp shaft 18 and the stamp adapter 1 also may have a different geometry.

The upper side of the tool insert 26 abuts with a lower side of the stamp shaft 18, and therefore, the tool inserts 26 can be immovably provided relative to them in the axial direction between the lower side of the stamp shaft 18 and the counterbore 15. Therefore, tool inserts 26 in two different sizes that are manufacturable with reduced manufacturing effort can be eccentrically received in a stamp shaft 18 using the stamp adapter 1.

Figure 4:
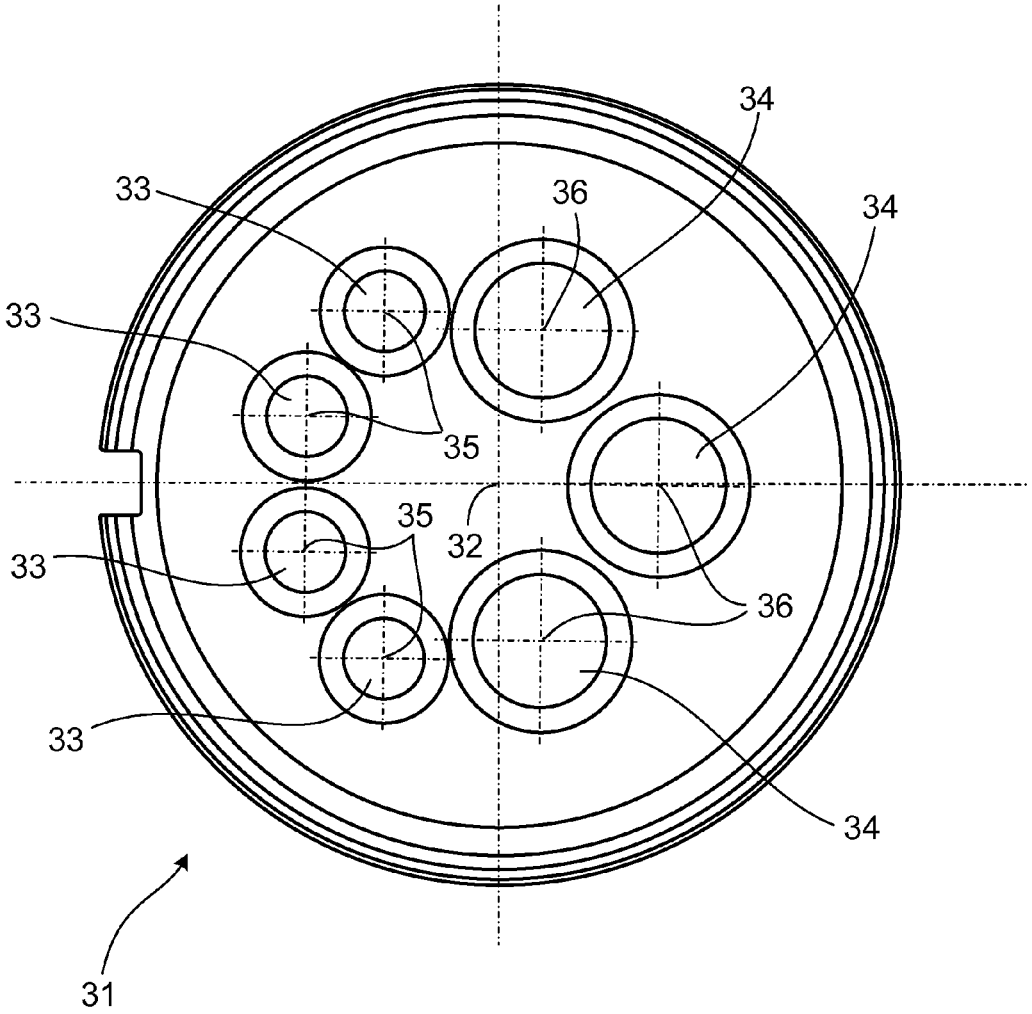
FIG. 4 is a schematic representation of a die adapter.

FIG. 4 illustrates a die adapter 31. The die adapter 31 is arranged in a later shown tool lower portion that is received in revolvable lower tool accommodation of a punching machine. The die adapter 31 includes a fourth central axis 32. In the die adapter 31, die accommodations 33 having a first opening, have a fifth central axis 35 in a distance c from the central axis 32, respectively, and die accommodations 34 having a second opening, have a sixth central axis 36 in a distance d from the central axis 32, whereby designing the second opening differently than the first opening.

The number of the die receptacles 33, 34 is variable dependent on the respective embodiment, whereby at least two die receptacles 33, 34 are provided in a die adapter 31.

Figure 5:
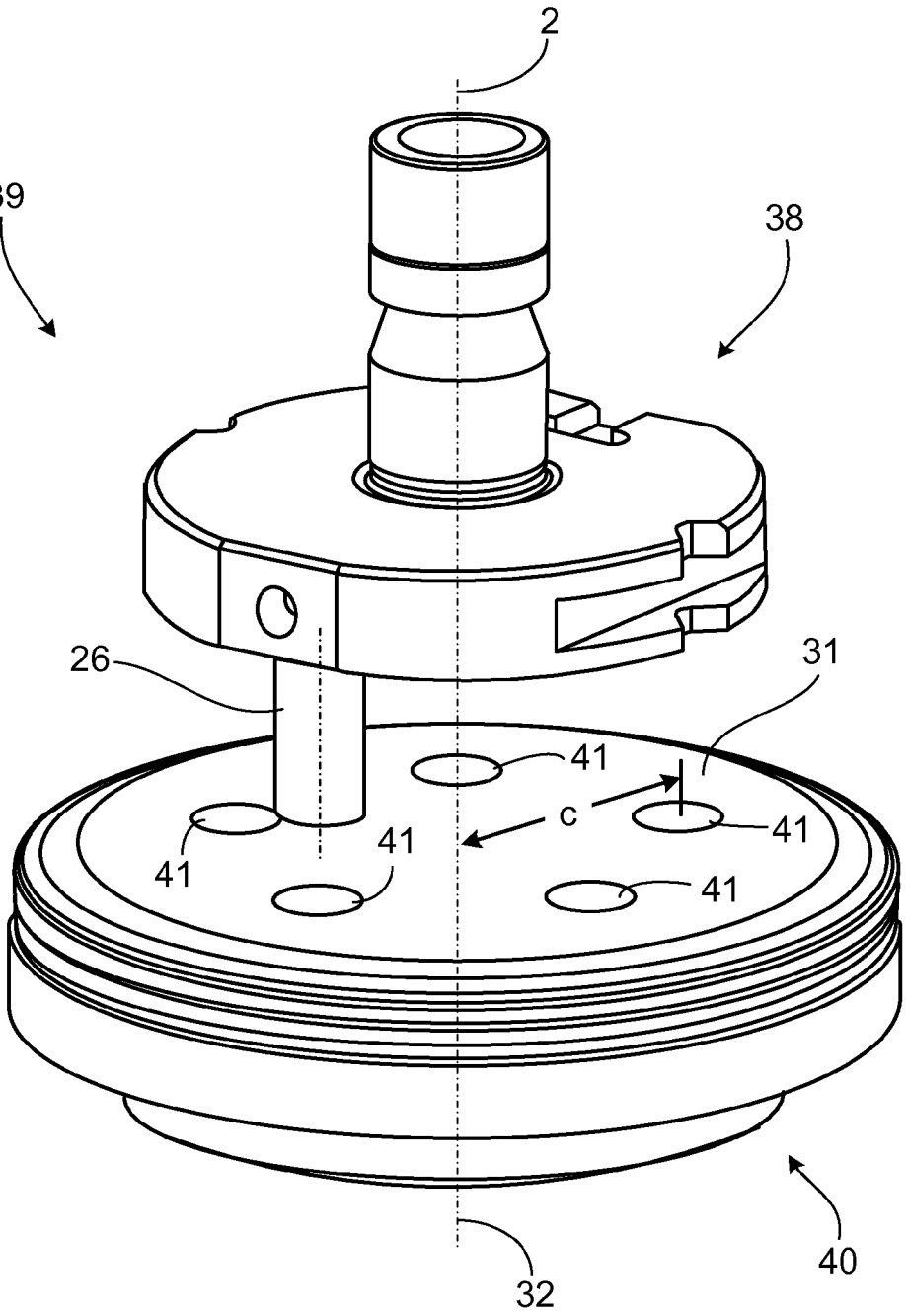
FIG. 5 is a perspective illustration of a tool set for punching.

FIG. 5 shows an illustration of a tool set 39 for punching with minimal retooling effort. The tool set 39 includes the tool upper portion 38. In the tool upper portion 38, a tool insert 26 is provided. In the present embodiment, the tool insert is a round pin having a certain diameter.

The die adapter is arranged in a tool lower portion 40. Here, in the die adapter 31, five different dies 41 are provided in the distance c from the central axis 2. The diameter of the dies 41 is bigger than the diameter of the tool insert 26 in the tool upper portion 38, respectively, in order to create a clearance between the tool insert 26 and the dies 41. The clearance is about 10% of the thickness of the sheet metal so that the diameters of the dies differ from each other, e.g., in a few tenth of a millimeter, in order to create the necessary clearance for the sheet metal in the respective thickness to be machined. The die 41 can be selected by twisting the tool upper portion 38 relative to the tool lower portion 40 having the die adapter.

If necessary, the tool upper portion 38 is pre-mounted for an operation in the punching machine, i.e., the connection of the stamp shaft 18 and the stamp adapter 1 is easily separated. In the present embodiment, the shaft 18 and adapter 1 are pulled apart by loosening and unscrewing of the screw 30, dismantling the tool upper portion into its two housing portions, and pulling apart the stamp shaft 18 and the stamp adapter. Then, the tool insert 26 is replaced from the stamp receptacle 10, 12 by pushing out the present tool insert 26 and inserting another tool insert in the suitable stamp receptacle 10, 12. Then, the adapter 1 is inserted into the stamp shaft 18 and fixed by the screw 30. Subsequently, the suitable dies are inserted into the die accommodations 33, 34 of the die adapter 31. Then, the tool upper portion 19 and the tool lower portion 40 are inserted into a tool cassette and they are prepared for using in the punching machine.

Other Embodiments

A number of embodiments have been described. Nevertheless, it will be understood that various modifications may be made without departing from the spirit and scope of the invention. Accordingly, other embodiments are within the scope of the following claims.

What is claimed is:

1. A tool upper portion comprising:

a stamp shaft comprising, around a first central axis of the stamp shaft, a first circular cylindrical counterbore at a first side of the stamp shaft and an additional second cylindrical counterbore and a stamp shaft through-hole having an above lying third cylindrical counterbore in the direction of the first central axis of the stamp shaft above the first circular cylindrical counterbore;

a stamp adapter comprising a first central axis of the stamp adapter extending through a center of the stamp shaft;

a mounting device on the stamp adapter for accommodating the stamp shaft; wherein the mounting device comprises a central thread around the first central axis of the stamp adapter to connect with the stamp shaft using a first screw; and at least one interchangeable tool insert, wherein the stamp shaft and the stamp adapter are constructed to form a rotation lock when engaged with one another, wherein the rotation lock comprises a monolithic elevation extending from a first side of the stamp adapter, and at least one recess defined in the first side of the stamp shaft, wherein each of the at least one recess is configured to engage the monolithic elevation, wherein the first side of the stamp adapter is arranged to face the first side of the stamp shaft when the monolithic elevation engages one of the at least one recess, wherein the at least one interchangeable tool insert can be eccentrically received and fixed at the stamp shaft, and wherein the stamp adapter comprises a first stamp adapter through-hole to receive a second screw for screwing on the interchangeable tool insert.

2. The tool upper portion of claim 1, wherein the stamp adapter comprises a first stamp receptacle having a first opening, which comprises:

a second central axis of the stamp adapter extending parallel to and separate from the first central axis of the stamp adapter;

a second stamp adapter through-hole through which the second central axis of the stamp adapter extends; and a first stamp adapter counterbore, wherein the first stamp adapter counterbore is not rotationally symmetrical with respect to the second central axis of the stamp adapter or the first stamp adapter counterbore comprises at least one recess that is not rotationally symmetrical with respect to the second central axis of the stamp adapter.

3. The tool upper portion of claim 1, wherein the stamp shaft is configured to be separated from the stamp adapter by loosening the first screw between the stamp shaft and the stamp adapter.

4. The tool upper portion of claim 2, wherein the stamp adapter further comprises a second stamp receptacle having a second opening, a third central axis of the stamp adapter extending parallel to and separate from the first central axis of the stamp adapter, a third through-hole, through which the third central axis of the stamp adapter extends, and a second stamp adapter counterbore, wherein the second stamp adapter counterbore is not rotationally symmetrical with respect to the third central axis of the stamp adapter or the second stamp adapter counterbore comprises at least one recess that is not rotationally symmetrical with respect to the third central axis of the stamp adapter.

5. The tool upper portion of claim 2, wherein the first stamp adapter counterbore comprises:

a first sector having a circular inner circumferential face with respect to the second central axis of the stamp adapter; and a second sector wherein an inner face of the second sector is parallel to a tangent of the second stamp adapter through-hole, and a distance between the inner face of the second sector and the second central axis of the stamp adapter is bigger than a radius of the first stamp adapter through-hole and smaller than a radius of the first sector of the first second stamp adapter counterbore.

6. The tool upper portion of claim 2, wherein the first stamp adapter counterbore is cylindrical.

7. The tool upper portion of claim 2, wherein the stamp adapter comprises a second stamp receptacle having a second opening and a third central axis of the stamp adapter, and wherein a distance between the first central axis of the stamp adapter and the second central axis of the stamp adapter is identical to a distance between the first central axis of the stamp adapter and the third central axis of the stamp adapter.

8. The tool upper portion of claim 4, wherein the stamp adapter comprises a third stamp receptacle having a third opening and a fourth through-hole with a fourth central axis of the stamp adapter, where a distance between the first central axis of the stamp adapter and the third central axis of the stamp adapter is identical to a distance between the first central axis of the stamp adapter and the fourth central axis of the stamp adapter.

9. The tool upper portion of claim 1, wherein the stamp adapter comprises:

a first stamp receptacle having a first opening and a second through-hole in the first opening, through which a second central axis of the stamp adapter extends in parallel with and separate from the first central axis of the stamp adapter; and a second stamp receptacle having a second opening and a third central axis of the stamp adapter extending parallel to and separate from the first central axis of the stamp adapter.

10. The tool upper portion of claim 9, wherein the second stamp receptacle comprises a second through-hole around the third central axis, the second stamp receptacle having a diameter that is different from a diameter of the first through-hole, and wherein the third central axis is separate from the second central axis.

11. A tool system for a punching machine, comprising:

a tool upper portion according to claim 2;

wherein the stamp adapter further comprises a second stamp receptacle having a second opening, a third central axis of the stamp adapter extending parallel to and separate from the first central axis of the stamp adapter, a third through-hole, through which the third central axis extends, and a second stamp adapter counterbore, wherein the second stamp adapter counterbore is not rotationally symmetrical with respect to the third central axis of the stamp adapter or the second stamp adapter counterbore comprises at least one recess that is not rotationally symmetrical with respect to the third central axis of the stamp adapter; and a tool lower portion comprising a die adapter having at least two die receptacles, wherein a die configured to receive the at least one interchangeable tool insert is provided in each of the receptacles.

12. The tool system for a punching machine of claim 11, wherein the die adapter comprises a fourth central axis and wherein each die receptacle comprises a respective fifth central axis, and a distance between the first central axis of the stamp adapter and the second central axis of the stamp adapter is identical to a distance between the fourth central axis and each of the fifth central axes.

13. The tool system of claim 12, wherein the die adapter comprises one or more additional die receptacles, each additional die receptacle having a respective opening and a respective sixth central axis, and a distance between the first central axis of the stamp adapter and the third central axis of the stamp adapter is identical to a distance between the fourth central axis and each sixth central axis.

* * * * *